United States Patent [19]

Kerr et al.

[11] Patent Number: 4,941,925

[45] Date of Patent: Jul. 17, 1990

[54] CLEANER FOR HIGH PRESSURE CLEANING OF FERROUS AND NON-FERROUS MATERIAL

[75] Inventors: E. Michael Kerr, Naperville; Bernard R. Szyszko, Warrenville, both of Ill.

[73] Assignee: Nalco Chemical Company, Naperville, Ill.

[21] Appl. No.: 439,847

[22] Filed: Nov. 21, 1989

Related U.S. Application Data

[63] Continuation of Ser. No. 160,732, Feb. 26, 1988, abandoned.

[51] Int. Cl.[5] ..... B08B 3/08

[52] U.S. Cl. ..... 134/3; 134/41; 134/28; 252/117; 252/174.19; 252/180; 252/DIG. 11

[58] Field of Search ..... 134/3, 41; 252/117, 252/82, 180, 174.19, DIG. 11, 546

[56] References Cited

U.S. PATENT DOCUMENTS

| | | | |
|---|---|---|---|
| 3,696,044 | 10/1972 | Rutledge | 134/3 |
| 3,962,149 | 6/1976 | Chirash et al. | 252/174.19 |
| 4,476,055 | 10/1984 | De Vernet | 252/174.19 |
| 4,863,628 | 9/1989 | Nambudiry | 252/174.19 |

FOREIGN PATENT DOCUMENTS

| | | | |
|---|---|---|---|
| 1939973 | 2/1970 | Fed. Rep. of Germany | 252/174.19 |
| 1275399 | 5/1985 | Japan | 252/117 |
| 617472 | 4/1976 | U.S.S.R. | 252/117 |
| 2182946 | 5/1987 | United Kingdom | 252/546 |

OTHER PUBLICATIONS

Derwent Abst. 87-017888/03 of Japan, No. 1,275,399 (Dec. 1986).

Derwent Abst. 42062B/22 of Soviet No. 617,472 (July 1978).

Merck Index, 9th Ed., pp. 22, 120-121, 967 and 1090 (1976).

*Primary Examiner*—Asok Pal

*Attorney, Agent, or Firm*—Joan I. Norek; Robert A. Miller; Donald G. Epple

[57] ABSTRACT

$C_6$-$C_{14}$ dicarboxylic acids and blends thereof are excellent for use in high pressure water spray systems for removing metal working compounds swarf and chips from ferrous and non-ferrous metals. Additionally, these compositions provide excellent corrosion inhibition for the cleaned metals.

6 Claims, No Drawings

CLEANER FOR HIGH PRESSURE CLEANING OF FERROUS AND NON-FERROUS MATERIAL

This is a continuation of application Ser. No. 07/160,732, filed Feb. 26, 1988, now abandoned.

INTRODUCTION

Most metal working operations leave the work piece coated with films of metal working lubricants and debris which are known as swarf and chips. To remove this debris from the surface of the work piece, it is common to utilize high pressure water sprays which contain surfactants and detergent formulas. These detergent sprays, while performing adequately to remove the residue from the work piece, have the disadvantage of generating large quantities of unwanted foam. Another disadvantage often experienced in using detergents in these cleaning operations is that stored work pieces tend to corrode. While it would be possible to incorporate corrosion inhibitors with the detergents they are frequently incompatible with the detergent formula or they are too costly.

If it were possible to provide an improved cleaning composition for use in the above described processes which not only was an outstanding cleaner but also imparted long-term corrosion protection to the cleaned workpiece, an advantage to the art would be afforded.

THE INVENTION

This invention provides an improved method of high-pressure detergent water cleaning of metal working compounds swarf and chips from ferrous and non-ferrous metal surfaces which comprises using as the detergent an aliphatic dicarboxylic acid which contains from 6–14 carbon atoms and mixtures thereof. In a preferred embodiment of the invention the dicarboxylic acids are employed as their alkanolamine salts. In a most preferred embodiment of the invention the dicarboxylic acids contain from 10–12 carbon atoms in the form of a mixture with the $C_{12}$ acid predominating.

The acids are employed in the form of aqueous solutions with the amount of the acids or mixtures thereof being within the range of 15–50% by weight. These solutions represent concentrates which are added to the water being used to high pressure spray the contaminated metal work piece. Use dilutions typically are from 0.5–10% by weight.

THE DICARBOXYLIC ACIDS

Typical dicarboxylic acids are: adipic, pimelic, suberic azelaic, sebacic, undecanedioic and dodecanedioic acids. The acids may be used alone or in combination with each other. An inexpensive source of these acids are obtained from the Nylon-cyclohexanone manufacturing processes. This technology of making adipic acid from cyclohexanone is described in *Kirk-Othmer, Encyclopedia of Chemical Technology,* Third Edition, Vol. 13, John Wiley & Sons, Inc., 1981, on Pg. 924, and in *Hydrocarbon Process.* 52, 118 (November 1973).

THE ALKANOLAMINES

The alkanolamines used to prepare the salts may be selected from such alkanolamines as those prepared by reacting ammonia with from 1–6 moles of ethylene or propylene oxide. Preferred are the mono, di, and triethanolamines. Triethanolamine is the most preferred. Other amines may be used but are less desirable. The amine used should be chosen so as not to produce a composition that tends to foam under conditions of use.

Illustrative of typical acid blends that can be used are the following:

| Ingredient | Percent by weight |
|---|---|
| Composition I | |
| DI water | 58.4% |
| Dodecanedioic acid | 7.05% |
| Undecanedioic acid | 1.97% |
| Sebacic acid | .50% |
| Triethanolamine 99% | 31.5% |
| Composition II | |
| DI water | 80% |
| Dodecanedinic acid, monoethanolamine salt | 20% |

EVALUATION OF THE INVENTION

EXAMPLE 1

Test Method:

Composition I was diluted in Chicago tap water at 0.5 to 4.0% in 0.5% increments. Five grams of plasma cleaned cast iron chips shifted to fall between a #10 and #20 mesh were added to 20 grams of each dilution. Immediately after two minutes of mixing for each, the solution was decanted and the chips were spread on filter paper in partially covered petri dishes. Twenty-four hours later, observations were made of rust stains on the filter papers.

The results are as follows:

| | |
|---|---|
| 0.5% rust spots | 2.5% no rust spots |
| 1.0% rust spots | 3.0% no rust spots |
| 1.5% no rust spots | 3.5% no rust spots |
| 2.0% no rust spots | 4.0% no rust spots |

EXAMPLE 2

Composition I was diluted to 1% and used in a high pressure spray cleaning system for the production of automobile engine blocks at a plant located in the Midwest. The result of this production application demonstrated excellent cleaning of residual metal working compounds swarf and chips from the engine blocks. Additionally, the engine blocks remained free of rust on prolonged storage with only the residual protection from Composition I. This cleaner system was run at 150 psig without producing any foam.

EXAMPLE 3

Composition I was diluted to 1½% and used in a 3,000 psig spray application for the cleaning of turbo charger parts in California. The cleaner solution provided excellent cleaning corrosion inhibition and no foam when used at this extremely high pressure application.

Having thus described our invention, we claim:

1. An improved method of spray cleaning of ferrous and non-ferrous metal surfaces to remove metal working compounds, swarf and chips from said surfaces which comprises spraying onto a ferrous or non-ferrous surface that is contaminated with at least one of metal working compounds, swarf and chips an aqueous detergent solution, the improvement comprising using as the detergent a composition consisting essentially of an aliphatic dicarboxylic acid having the formula of $HO_2C—(CH_2)_n—CO_2H$ wherein n is an integer of from 4 to 10 and mixtures thereof, in water-soluble alkanolamine salt form.

2. The method of claim 1 wherein said dicarboxylic acid is dodecanedioic acid.

3. The method of claim 1 wherein said dicarboxylic acid is a mixture wherein said n is an integer of from 8 to 10, of which said dicarboxylic acid wherein said n is 10 is a major portion.

4. The method of claim 1 wherein said alkanolamine salt is the triethanolamine salt.

5. The method of claim 1 wherein said aqueous detergent solution is sprayed onto said surface at a pressure of 150 psig or higher.

6. The method of claim 1 wherein said aqueous detergent solution contains from about 0.5 to about 10.0 weight percent of said detergent.

* * * * *